United States Patent [19]

Faye

[11] 4,413,449

[45] Nov. 8, 1983

[54] MOTORIZED SYSTEM FOR CLEANING DRAIN TROUGHS

[76] Inventor: Lloyd H. Faye, 8821 Elm Rd., Richmond, Va. 23235

[21] Appl. No.: 342,246

[22] Filed: Jan. 25, 1982

[51] Int. Cl.[3] ..... E05D 5/06

[52] U.S. Cl. ..... 52/16; 16/242; 16/389; 192/142 R; 248/48.2; 405/119

[58] Field of Search ..... 16/223, 239, 242, 355, 16/356, 387, 389, 390, 391, 392; 405/119; 52/11, 16; 248/48.1, 48.2; 192/142 R, 143; 318/467

[56] References Cited

U.S. PATENT DOCUMENTS

| | | | |
|---|---|---|---|
| 538,108 | 4/1895 | Freeze | 52/11 |
| 2,523,435 | 9/1950 | Jones . | |
| 3,065,398 | 11/1962 | LaBov | 318/467 |
| 3,069,611 | 12/1962 | Warlé et al. | 318/467 |
| 3,630,473 | 12/1971 | Landis | 248/48.2 |
| 3,751,749 | 8/1973 | Wilson | 15/92 |
| 3,914,676 | 10/1975 | Maldonian et al. | 318/467 |
| 4,014,074 | 3/1977 | Faye | 16/392 |
| 4,072,285 | 2/1978 | Greenwood | 52/11 |
| 4,116,008 | 9/1978 | Ward | 52/11 |
| 4,117,635 | 10/1978 | Nelson | 52/11 |
| 4,199,121 | 4/1980 | LeFebvre | 248/48.2 |
| 4,241,547 | 12/1980 | Bové | 52/11 |
| 4,309,792 | 1/1982 | Faye | 16/389 |

*Primary Examiner*—Fred A. Silverberg
*Attorney, Agent, or Firm*—Norman B. Rainer

[57] ABSTRACT

A drain trough system is disclosed wherein the drain trough may be mechanically inverted to permit any debris therein to fall out. The system involves a series of hinged mounting brackets in horizontally spaced alignment, at least one of the mounting brackets being motorized, a length of drain trough supported by the mounting brackets, and a downspout associated with the drain trough. The motorized mounting bracket includes an electric motor positioned below the bracket, a drive mechanism fixedly attached to the spindle of the motor, and a driven mechanism activated by the drive mechanism and associated with a pivotable upper harness member of the mounting bracket.

5 Claims, 7 Drawing Figures

MOTORIZED SYSTEM FOR CLEANING DRAIN TROUGHS

BACKGROUND OF THE INVENTION

This invention relates to an improvement in a drain trough system generally associated with the eaves of a roof of a building, and is more particularly concerned with motorized apparatus which facilitates the cleaning and inspection of drain troughs.

Most residential-type houses or dwellings are constructed with pitched roofs, the slopes nature of which prevents the accumulation of water thereon. Beneath the lower extremity of a pitched roof, generally referred to as the eaves, there is positioned a drain trough or gutter, the purpose of which is to catch water which runs off the roof, and channel it to a downspout which leads the water away from the foundation of the house.

In the course of time, such drain troughs tend to accumulate debris such as fallen leaves, which obstructs the trough, thereby rendering it ineffective for its intended purpose. Also, in the course of time, the trough, usually of metal construction, may require maintenance such as scraping and/or painting. The servicing of such troughs for the purposes of cleaning or painting generally requires the use of a ladder, which makes the task difficult and often perilous.

Although a number of methods have been previously disclosed for simplifying the servicing of eaves-mounted drain troughs, none have been completely successful in operation or sufficiently practical to enjoy widespread commercial utilization. Mechanically modified drain troughs have been proposed, such as the one disclosed in U.S. Pat. No. 538,108, issued Apr. 23, 1895, which enable the trough to be manually tilted or inverted so that its contents will dump out. However, the specific features of such systems generally require use of costly non-standard, specifically constructed drain troughs. Also, their installation onto the eaves of a house may be so difficult as to render them impractical. This is particularly the case with modern houses wherein the roof overhangs by not more than about two inches the upper peripheral wooden trim panels of the underlying walls, said panels being generally referred to as the fascia.

The use of hinged brackets to mount a standard drain trough to the fascia in a manner permitting inversion of said trough to discharge its contents has been disclosed in U.S. Pat. No. 4,014,074. Related devices are disclosed in U.S. Pat. Nos. 4,117,635 and 4,116,008.

The use of motorized means for cleaning debris from drain troughs and their associated downspouts has been disclosed in U.S. Pat. No. 4,241,547. In said device, motorized means acts directly upon the debris in a propulsive manner, whereby its effectiveness is dependent upon the nature and amount of said debris.

It is accordingly an object of the present invention to provide motorized apparatus to facilitate the cleaning and inspection of a drain trough.

It is another object of this invention to provide apparatus for the motorized removal of debris from a drain trough wherein said motorized removal does not act directly upon said debris in a propulsive manner.

It is a further object of this invention to provide a drain trough system involving motorized means for dumping debris from said trough.

It is a still further object of the present invention to provide a motorized apparatus of the aforesaid nature of simple and rugged construction which can be economically manufactured.

These objects and other objects and advantages of the invention will be apparent from the following description.

SUMMARY OF THE INVENTION

The above and other beneficial objects and advantages are accomplished in accordance with the present invention by an improved drain trough system which utilizes motorized apparatus to invert said drain trough.

The drain trough system of the present invention is comprised of at least one length of conventional gutter drain trough and associated downwspout, a number of hinged mounting brackets adapted to attach to said trough and also to the fascia of a building, and motorized means associated with at least one of said hinged brackets.

The mounting brackets useful in the practice of this invention are comprised of:

(a) a harness member of integral monolithic construction comprised of a flat rear panel, and a flat bottom panel emanating from the lowermost extremity of said rear panel and terminating in front extremity, (b) a bracket member of integral monolithic construction having a generally L-shaped configuration comprised of a flat vertical panel, and a horizontal panel emanating from the lowermost extremity of said vertical panel and terminating in a forward extremity, (c) said harness member being positioned above said bracket member and closely adjacent thereto in nested configuration, and (d) hinge means associated with the forward extremity of said bracket member and front extremity of said harness member causing pivoted interengagement of said members.

Specific embodiments of hinged mounting brackets useful in the practice of this invention are disclosed in U.S. patent application Ser. No. 148,082, filed May 12, 1980, now U.S. Pat. No. 4,309,792. Such mounting brackets are constructed in a manner such that the vertical panel of the bracket member attaches to the fascia, and the harness member attaches to the drain trough.

The motorized apparatus of the present invention is comprised of an elecric motor having fixedly attached to the shaft thereof drive means whose distal extremity engages driven means associated with the harness member of a mounting bracket. The motor is positioned below the mounting bracket with which it is associated, and is attached either to the fascia or the bracket member of the mounting bracket. The motor is adapted to cause the harness member to pivot at least 180° about said hinge means, and then return said harness member to its starting position. Because the several hinged harness members are interconnected by the drain trough, when the motorized mounting bracket is pivoted, all harness members and the trough pivot in unison. Likewise, all harness members are restored to their original upright position as the motorized mounting bracket restores the trough to its upright position.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
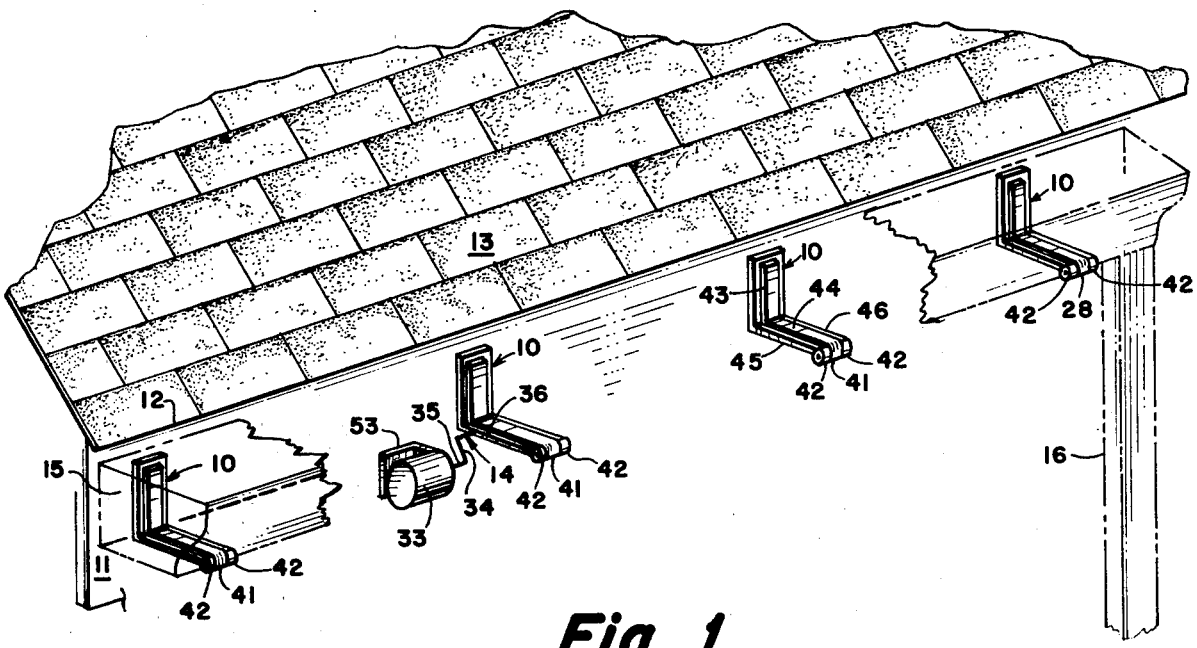
FIG. 1 is a front perspective view of an embodiment of the drain trough system and motorized apparatus of the present invention.

Referring to FIG. 1, a drain trough system of the present invention is shown comprised of (a) a series of substantially identical hinged mounting brackets 10 attached to the fascia 11 below the edge 12 of roof 13, (b) motorized apparatus 14 associated with at least one of said mounting brackets, (c) a length of drain trough 15 held by said mounting brackets, and (d) a downspout 16 associated with said drain trough.

Figure 2:
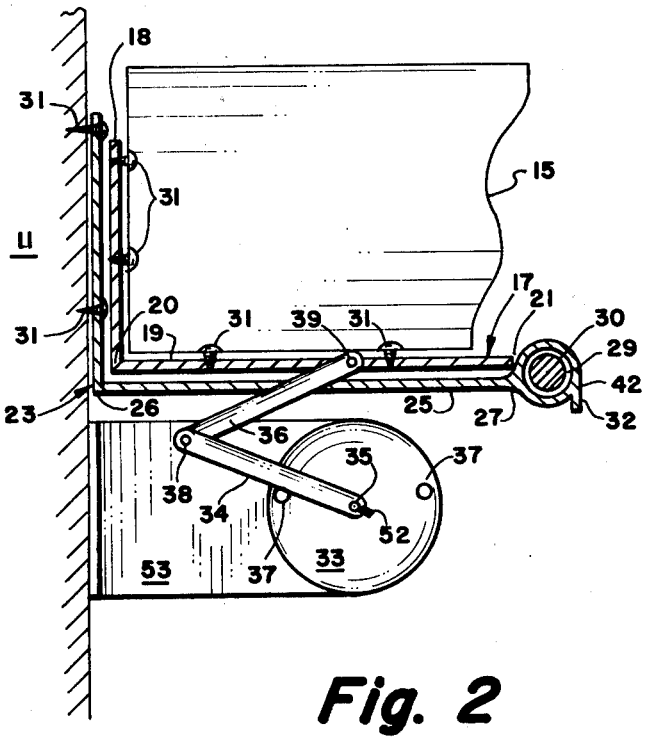
FIG. 2 is an enlarged side view of the motorized apparatus of FIG. 1 associated with a drain trough.
Figure 3:
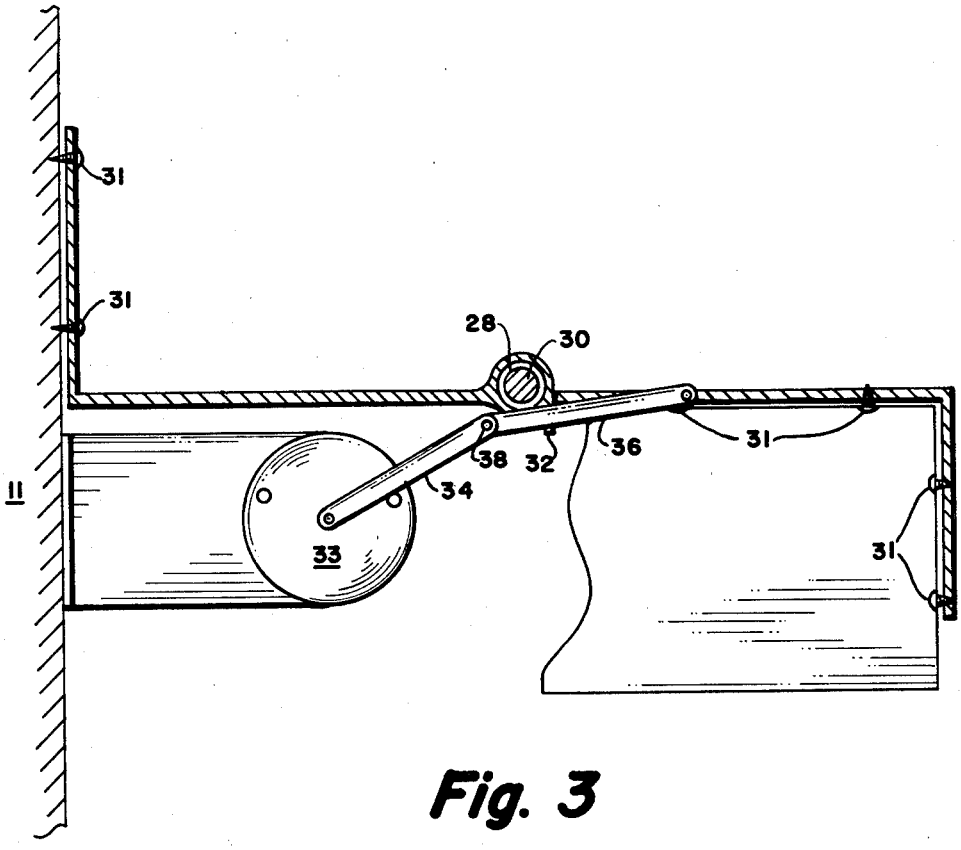
FIG. 3 is a side view showing the motorized apparatus of FIG. 2 in its inverted mode.
Figure 4:
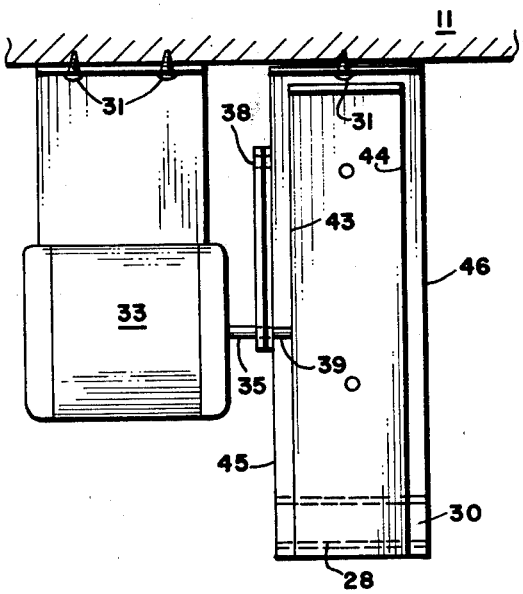
FIG. 4 is a top view of the apparatus of FIG. 2 without the drain trough.
Figure 5:
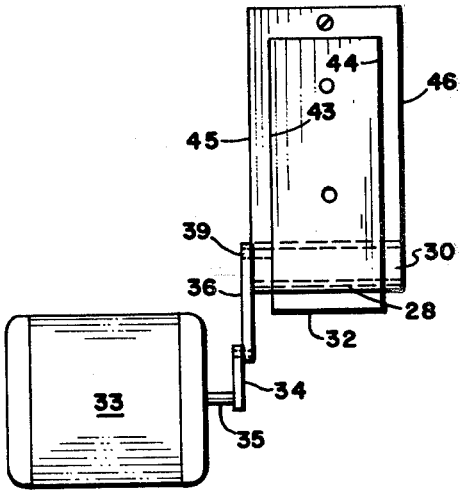
FIG. 5 is a front view of the apparatus of FIG. 2 without the drain trough.

Referring to FIGS. 2 and 3, each hinged mounting bracket 10 is comprised of (a) a harness member 17 comprised of a flat rear panel 18, a flat bottom panel 19 emanating from the lowermost extremity 20 of said rear panel and terminating in a front extremity 21, and a first hinge component in the nature of cylindrical housing 41 formed as an integral extension of front extremity 21, and having centered therein circular cylindrical channel 28, shown in FIGS. 4 and 5, (b) a bracket member 23 having a generally L-shaped configuration comprised of flat vertical panel 24, horizontal panel 25 emanating from the lowermost extremity 26 of said vertical panel and terminating in a forward extremity 27, and a second hinge component in the nature of spaced-apart cylindrical housings 42 integral with forward extremity 27, said housings having axially aligned circular cylindrical channels 29, and (c) a third hinge component in the form of cylindrical shaft 30 which engages channels 28 and 29.

The widths of the rear and bottom panels of the harness member are preferably but not necessarily equal, said widths being determined by the perpendicular distance between side edges 43 and 44, shown in FIGS. 4 and 5. Likewise, the widths of the vertical and horizontal panels of the bracket member are preferably but not necessarily equal, and widths being taken between side edges 45 and 46.

Harness member 17 is positioned above bracket member 23 in close abutment therewith in a nested juxtaposition. Both members are preferably of integral monolithic construction, having been formed by molding, extrusion, roll-forming or bending operations. In the illustrated embodiment, channels 28 and 29 are brought into alignment by shaft 30 to form a hinge means of the aforesaid three basic components which pivotably joins harness member 17 to bracket member 23. Other specific embodiments of hinge means may be utilized in association with the forward extremity of the mounting bracket structure to provide equivalent function.

In use, bracket member 23 is attached to the fascia of a building by fastening means such as nails, screws or rivets 31 driven through vertical panel 24, or adhesives applied to the rear of said panel. Equivalent fastening means are employed to attach the drain trough to the rear panel 18 and bottom panel 19 of said harness member. Still further techniques may however be employed to seat the drain trough in the harness member. In its pivoted movement about bracket member 23, harness member 17 travels through a circular arc of at least 180°, as indicated by comparisons of the trough positions in FIGS. 2 and 3. Abutment means in the form of downwardly directed tabs 32 integral with housing 42 serve to prevent further downward movement of the harness members and drain trough. Other equivalent abutment means may however be utilized to limit the downward movement of the drain trough.

The embodiment of motorized apparatus of this invention shown in FIGS. 1–5 comprises a hinged mounting bracket of the aforesaid nature, an electrical motor 33 attached by mounting means 53 to the fascia, drive means in the form of a first lever 34 fixedly attached by set screw 52 to spinde 35 of said motor, driven means in the form of second lever 36 which attaches by pivot means 38 to lever 34 and by pivot rod 39 to the bottom panel of said harness member, and control means in the form of electrical switches 37 which control the direction and extent of movement of said harness member.

Figure 6:
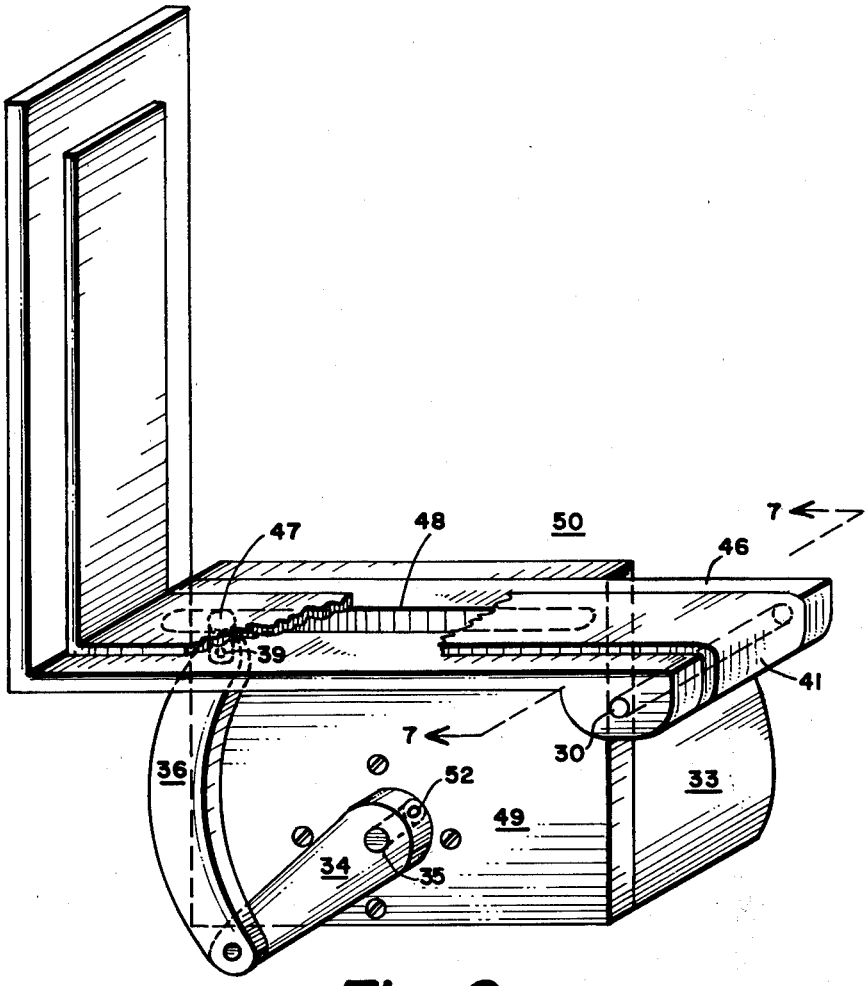
FIG. 6 is a front perspective view of an alternative embodiment of motorized apparatus of FIG. 2, portions being broken away to reveal interior detail.
Figure 7:
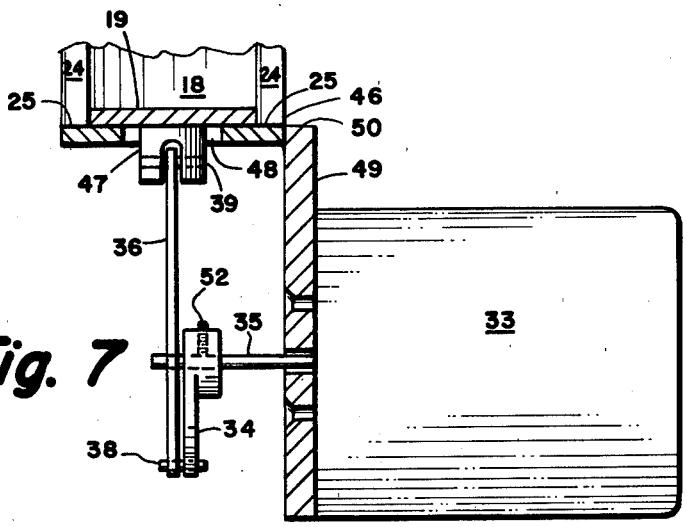
FIG. 7 is a sectional view taken on the line 7—7 of FIG. 6.

In the embodiment of FIGS. 1 through 5, driven means in the form of lever 36 is shown pivotably connected at one end to the distal extremity of lever 34, and connected at its other end to pivot means in the form of pivot rod 39 which extends laterally from side edge 43 of bottom panel 19 of the harness member. In such manner of construction, upward motion of lever 36 during the trough inverting manipulation is unimpeded by the bracket member. In the embodiment of motorized apparatus illustrated in FIGS. 6 and 7, pivot rod 39 is positioned in post 47 centered in the underside of said bottom panel of the harness member. In such position, the upward force transmitted by the motor is evenly distributed to said bottom panel and is less likely to impart a twisting effect to said panel. However, in order to permit unimpeded motion of lever 36, an elongated access slot 48 is provided in horizontal panel 25, through which lever 36 is adapted to pass. It is also to be noted that, in the embodiment of FIGS. 6 and 7, motor 33 is attached to mounting plate 49, through which spindle 35 penetrates. The upper edge 50 of said mounting plate is joined to side edge 46 of the horizontal panel of the bracket member by welding, bolting, or equivalent means. The driven means 36 is in the form of an arcuate lever pivotably attached to drive means 34 and pivot rod 39.

Electrical motors suitable for use in the practice of this invention are of fractional horsepower operable on AC or DC voltages up to 115 volts, and are reasonably enclosed for protection against damaging effects of water. A suitable gear mechanism is associated with the rotor component of the motor so that a relatively low spindle r.p.m. is produced. Drive means 34 may in alternative embodiments be a geared member, pulley wheel or other mechanical structure capable of controllably transmitting force to another member mechanically coupled therewith. The driven means, exemplified as a lever coupled by pivot means to drive means 34, may also have other specific mechanical forms. For example, said driven means may be a toothed member interactive with a geared drive means.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A motorized mounting bracket for a drain trough comprising:

(a) a mounting bracket comprised of:

(1) a harness member comprised of a flat rear panel and a flat bottom panel emanating from the lowermost extremity of said rear panel and terminating in a front extremity, (2) a bracket member having a generally L-shaped configuration comprised of a flat vertical panel and a flat horizontal panel emerging from the lowermost extremity of said vertical panel and terminating in a forward extremity, (3) said harness member being adapted to be positioned above said bracket member and closely adjacent thereto in nested configuration, and (4) hinge means associated with the forward extremity of said bracket member and front extremity of said harness member, causing rotative interengagement of said members, (b) an electric motor and associated spindle, said motor adapted to be positioned below said mounting bracket, (c) drive means fixedly attached to said spindle and adapted to mechanically transmit rotative force, (d) driven means associated with said harness member and adapted to receive motivating force from said drive means, and (e) control means to constrain the motor to cause said harness member to rotate at least 180° about said hinge means and then return to its starting position.

2. A drain trough system comprising:

(a) the motorized mounting bracket of claim 1, (b) additional non-motorized hinged mounting brackets in horizontally spaced alignment with said motorized mounting bracket, (c) a length of drain trough supported by said motorized and non-motorized hinged mounting brackets, and (d) a downspout associated with said drain trough.

3. The motorized mounting bracket of claim 1 wherein said driven means is a substantially flat lever pivotably associated with the bottom panel of said harness member.

4. The motorized mounting bracket of claim 3 wherein said flat lever pivotably attaches to the center of the underside of said bottom panel, and is adapted to pass through an elongated slot in the horizontal panel of said bracket member.

5. The motorized mounting bracket of claim 1 wherein said motor is of water-resistant construction and adapted to provide a slow spindle speed.

* * * * *